US006565368B1

(12) United States Patent
Liao et al.

(10) Patent No.: US 6,565,368 B1
(45) Date of Patent: May 20, 2003

(54) CONTACT OF SOCKET-TYPE ELECTRICAL CONNECTOR

(75) Inventors: Fang-Chu Liao, Tu-Chen (TW); Nick Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/141,590

(22) Filed: May 7, 2002

(30) Foreign Application Priority Data

Dec. 19, 2001 (TW) ..... 90222277 U

(51) Int. Cl.[7] ..... H01R 9/09
(52) U.S. Cl. ..... 439/83; 439/342
(58) Field of Search ..... 439/83, 342, 259, 439/261, 263–266, 330, 331

(56) References Cited

U.S. PATENT DOCUMENTS 4,498,725 A * 2/1985 Bright et al. ..... 439/347
5,057,031 A * 10/1991 Sinclair ..... 439/261
5,299,950 A * 4/1994 Kaneko ..... 439/342
6,319,038 B1 * 11/2001 Howell et al. ..... 439/342
6,488,523 B1 * 12/2002 Lai ..... 439/342

* cited by examiner

*Primary Examiner*—Hien Vu
(74) *Attorney, Agent, or Firm*—Wei Te Chung

(57) ABSTRACT

An electrical connector includes an insulative housing defining a plurality of channels and each channel receives a contact (3) therein. The contact includes a base portion (12) having upper and lower edges (14, 13). Two support portions (22, 23) extend from the upper edge of the base portion and are spaced apart from each other. A pair of arms (221, 231) is separately formed on the support portions, each being substantially perpendicular to the support portion. A gap is defined between the arms and is resiliently adaptable to receive a CPU pin in a range of diameters. At least a recess (222) is defined in the support portion adjacent to a junction between the arm and the support portion. A soldering portion (11) extends from the lower edge of the base portion for soldering to an external device.

7 Claims, 5 Drawing Sheets

3

CONTACT OF SOCKET-TYPE ELECTRICAL CONNECTOR

BACKGROUND OF THE INVENTION

1. Field of the Invention

The present invention relates generally to a Zero Insertion Force (ZIF) socket electrical connector, and particularly to a ZIF socket connector having an improved contact.

2. Description of Related Art

Zero Insertion Force (ZIF) socket type electrical connectors have been widely used for connecting electronic devices such as central processing unit (CPU) packages to, for example, a printed circuit board. A socket connector generally comprises an insulative housing or base in which a plurality of bores or channels is defined, each receiving and retaining a conductive contact. Each bore forms an interior space that is large enough so that the contact that is received in the bore occupies only a fraction of the space. An extra free gap is thus left in the bore for receiving a corresponding pin of the electronic device therein with substantially no resistance. Once the pin is placed into the extra free gap, the electronic device is moved with respect to the housing, driving the pin into engagement with a resilient arm of the contact. The arm is then deflected by the pin, ensuing a stable engagement between the pin and the arm.

Some of the conventional contacts designed for such purposes have a single arm. Examples are described in U.S. Pat. Nos. 5,052,101 and 5,489,218. A disadvantage associated with the single-armed contact is that the pin is subjected to a moment caused by the resilient force of the single arm. In addition, due to the small size of the contact and the high density of the contacts arranged in the housing, the pins of the electronic device must be perfectly aligned with the corresponding contacts before the pins are driven to engage the arms of the contacts. This is in general very difficult to accomplish.

Others conventional contacts have a design with two arms wherein the two resilient arms extend from opposite edges of a substantially rigid base section. U.S. Pat. Nos. 3,955,869 and 5,299,950 describe such contacts. Generally, the arms of such contacts are opposed to one other and define a gap of a distance generally smaller than a diameter of the corresponding pin of the electronic device. When the pin is driven into the gap between the arms, the arms are deflected away from each other to accommodate the pin. The axes about which the arms deflect pass through a junction between the corresponding arm and the base. The axes are changelessly located at the junctions. The gap, therefore, is invariable. So changes in the diameter of the pin, or in the thickness of the contact, produces undue pressure between the arms and the pin, and thereby affects the electrical and mechanical performance of the connector. Furthermore, rigidity of the junction affects the deflection of the arm. When the rigidity is increased, the deflection is reduced. When the rigidity is reduced, the deflection is increased. A new design is required to improve an adaptability of a gap between the arms.

A contact structure of an electrical connector is desired to alleviate or even eliminate the above-discussed problem.

SUMMARY OF THE INVENTION

Accordingly, an object of the present invention is to provide a contact of an electrical connector comprising two arms designed such that a distance between the arms is adjustable for engaging with a pin of the electronic device inserted.

To achieve the above object, a contact in accordance with the present invention, comprises a base portion having upper and lower edges. Two support portions extend from an upper edge of the base portion and are spaced apart from each other. A pair of arms separately protrude from the support portions. A gap is defined between the arms. Each arm is spaced from the upper edge of the base portion a different distance, whereby the arms are staggered with respect to each other. At least a recess is defined in an upper end of each support portion adjacent to a junction between the arm and the support portion. A soldering portion extends from the lower edge of the base portion and is adapted to be soldered to an external device.

DETAILED DESCRIPTION OF THE PREFERRED EMBODIMENT

An electrical connector generally comprises an insulative housing defining a plurality of channels for receiving and retaining a plurality of conductive contacts therein. The contacts are usually designed to meet certain mechanical and electrical performance requirements. FIGS. 1–5 show a contact constructed in accordance with the present invention. Such a contact is in general adapted for use in a socket-type connector. One potential use of such a socket connector is to mount it on a printed circuit board, to connect an electronic device, such as a central processing unit (CPU) package, to the printed circuit board. The following description of the contact of the present invention is illustrative only, and is not intended to restrict the use and application of the contact. In addition, the contact of the present invention can also be adapted for use in connectors of other types or with different devices.

Figure 1:
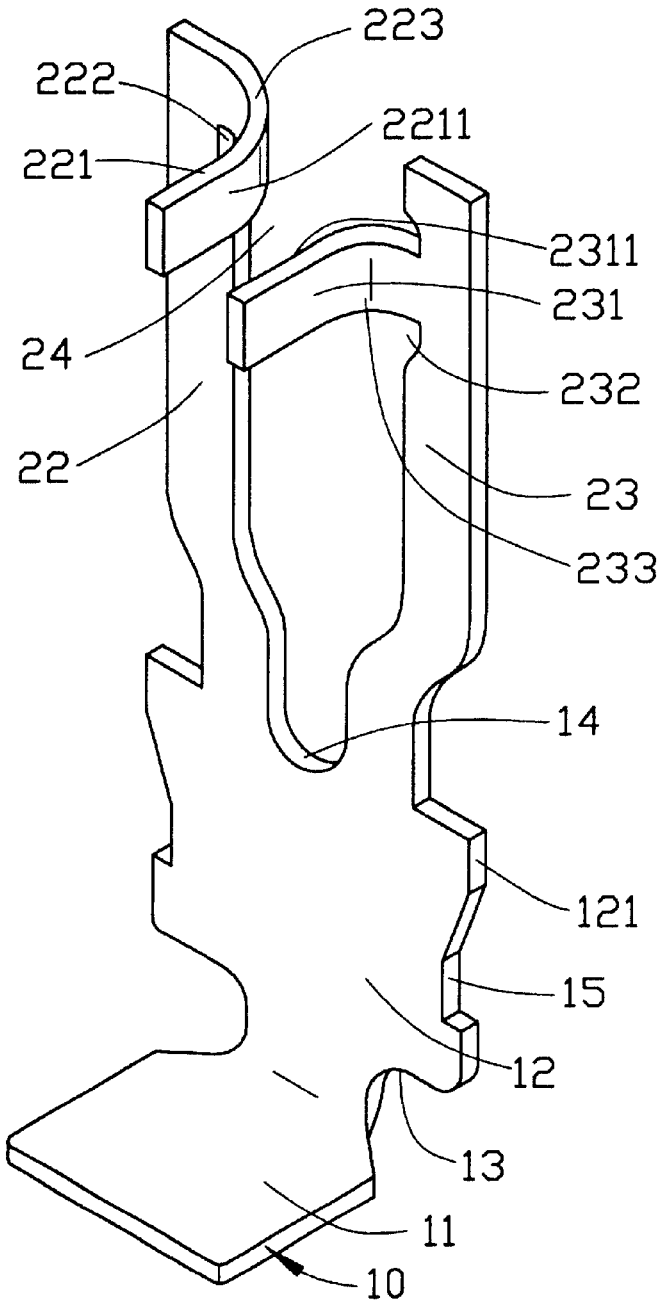
FIG. 1 is a perspective view of a contact in accordance with the present invention.

Referring to FIG. 1, a contact constructed in accordance with the present invention, generally designated with reference numeral 3, comprises a base portion 12 having lower and upper edges 13, 14 and opposite side edges 15 connecting the lower and upper edges 13, 14. Retention portions, such as barbs 121, are formed on each side edge 15 of the base portion 12. The barbs 121 mechanically interfere with side walls of a channel defined in an insulative housing (not shown) in which the contact 3 is retained. The interferential engagement between the barbs 121 and the walls securely retains the contact 3 in position inside the channel.

Figure 2:
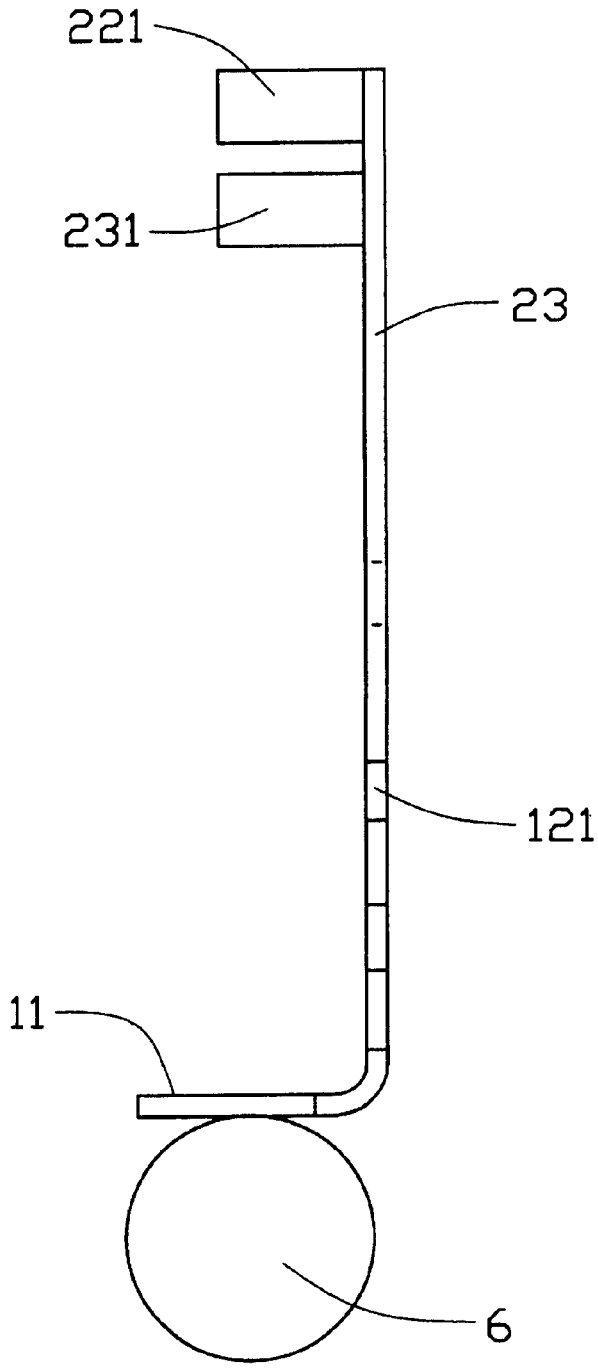
FIG. 2 is a side elevational view of the contact shown in FIG. 1 with a solder ball attached therebelow.
Figure 3:
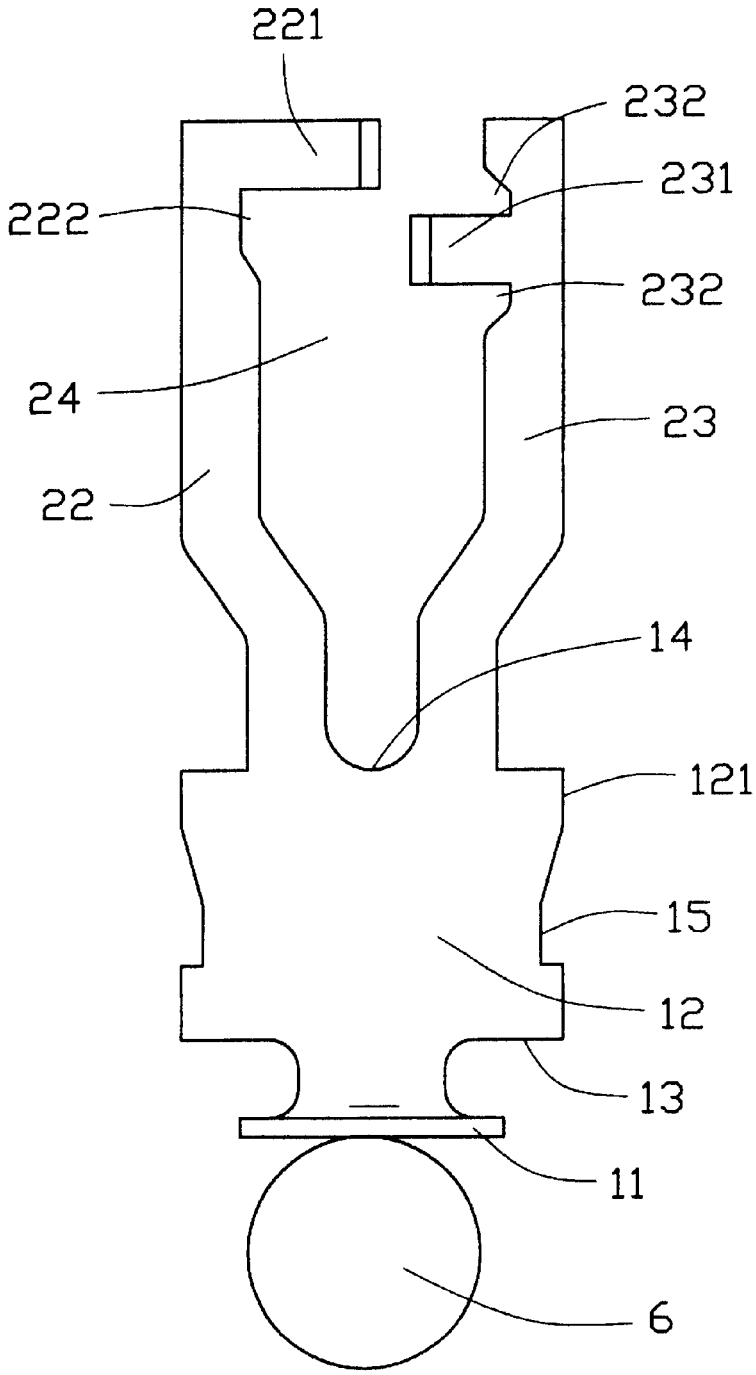
FIG. 3 is a front elevational view of the contact of the present invention.

Referring to FIGS. 1–2, a lower extension 10 is formed on the lower edge 13 of the base portion 12. A free end of the lower extension 10 forms a soldering portion 11 which, in the embodiment illustrated comprises a platform extending in a direction substantially perpendicular to the base portion 12 for carrying a solder ball 6 or a mass of soldering material. The contact 3 is so arranged in the corresponding channel of the housing that the solder ball 6 at least partially extends beyond the housing for being soldered to a conductive pattern formed on the printed circuit board.

Alternatively, but not shown in the drawings, the soldering portion of the lower extension 10 may be formed as an elongated pin extending in a direction substantially parallel to the base portion 12 for being received in a hole defined in a printed circuit board. Soldering may then be employed to fix the pin to the printed circuit board, forming an electrical connection therebetween.

First and second support portions 23, 22 extend from the upper edge 14 of the base portion 12. In the embodiment illustrated, the support portions 23, 22 are spaced apart from each other. Each support portion 23, 22 has an inner edge facing the inner edge of the opposite support portions 22, 23. A pair of arms 231, 221 is separately formed on the support portions 23, 22 and an angle is defined between each arm 231, 221 and the corresponding support portion 23, 22. Corresponding to the angle, a pair of arc portions 233, 223 extends from the inner edges of support portions 23, 22 and connects the corresponding arms 231, 221 to the support portions 23, 22. In other words, the arms 231, 221 originally each extends from an inner edge of a support portion 23, 22 toward an opposite support portion 22, 23 and then bend a certain angle, forming the arc portions 233, 223, during stamping of the contact 3 from a sheet of metal. In the embodiment illustrated, the angle is substantially 90 degrees for example and the arms 231, 221 are substantially perpendicular to the support portions 23, 22.

The arms 231, 221 are arranged in a staggered fashion forming a nonsymmetric configuration. In other words, the distance between the first arm 231 and the upper edge 14 of the base portion 12 is different from (less than, in this case) that between the second arm 221 and the upper edge 14 of the base portion 12.

Figure 4:
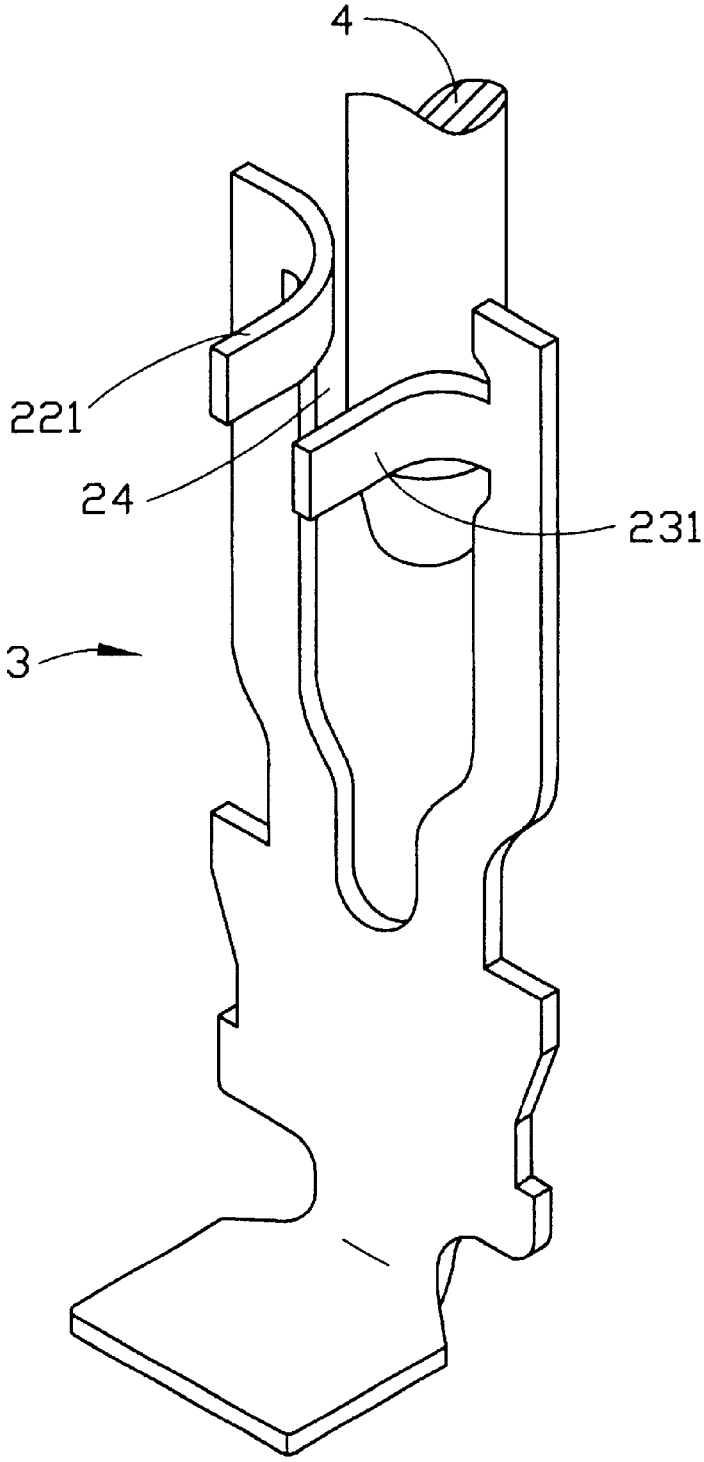
FIG. 4 is a perspective view of the contact of FIG. 1 with a pin of a CPU.
Figure 5:
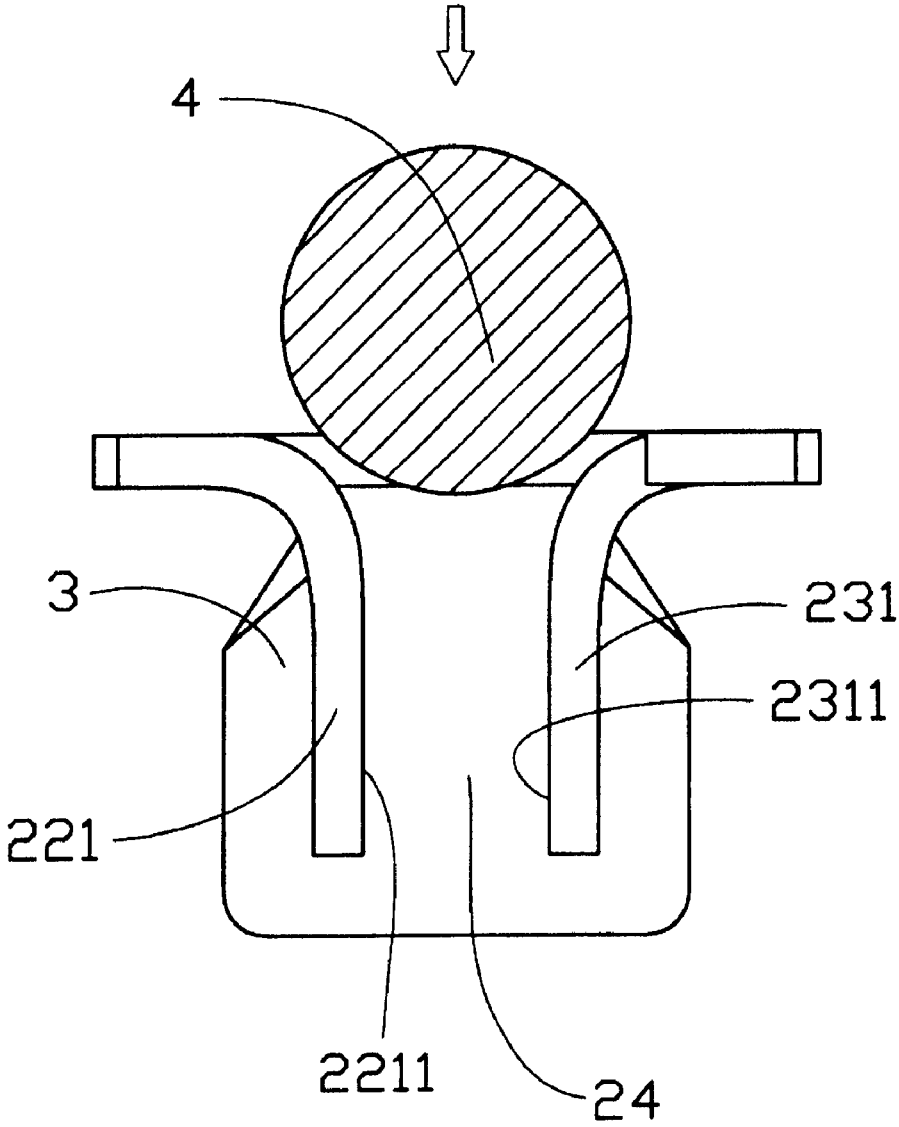
FIG. 5 is a top view of FIG. 4.

Referring to FIGS. 4–5, the arms 231, 221 are spaced apart from each other and each arm 231, 221 has a contacting face 2311, 2211. A gap 24 is defined between the contacting faces 2311, 2211 and is adapted to receive and retain a CPU pin 4 therein. The width of the gap 24, or the distance between the contacting face 2311 and the contacting face 2211, is smaller than a diameter of the pin 4.

The length of the support sections 23, 22 is much greater than the width of the support sections 23, 22 so that the support sections 23, 22 are relatively readily deflected/deformed. To aid this affect, the barbs 121 are located as far from the arms 231, 221 as possible. Compared to the support sections 23, 22, the arms 231, 221 are much shorter, making them relatively rigid.

A second recess 222 is defined in an inner edge of the second support portion 22 adjacent to a junction between the second arm 221 and the support portion 22. A pair of first recesses 232 is defined in an inner edge of the first support portion 23 at opposite sides of the first arm 231. Due to the recesses 222, 232, an axis about which the arms 231, 221 deflect varies along the arc portions 223, 233, and the rigidity of the arc portions 223, 233 is reduced so that the deflections are adaptably variable to accommodate different sized CPU pins 4. So, a width of the gap 24 is adjustable for receiving and retaining different sized CPU pins 4.

In use, the contact 3 is retained in a corresponding channel of the insulative housing of the connector by means of the barbs 121 mechanically interfering with side walls of the channel. When the CPU pin 4 is moved into the gap 24, because of the recesses 222, 232, the arms 231, 221 can bend properly to accommodate the diameter of the CPU pin 4, and the support portions 23, 22 also deflect. The gap 24, therefore can accommodate the CPU pins 4 in a range of diameters.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact adapted to be retained in a channel defined in a housing, the contact comprising:

a base portion having upper and lower edges, the base portion adapted to be retained in the channel of the housing;

two support portions extending from the upper edge and spaced apart from each other;

a pair of arms separately formed on the support portions, an angle being defined between each arm and the corresponding support portion, a gap being defined between the pair of arms, the arms being spaced from the upper edge of the base portion whereby the arms are staggered with respect to each other;

a soldering portion extending from the lower edge of the base portion and adapted to be soldered to an external device; and a recess defined in each support portion adjacent to a junction between the arm and the support portion for making the gap resiliently adaptable for accommodating different sized pins; wherein each support portion has an inner edge facing each other, an arc portion extending from the inner edge of each support portion and connecting the corresponding arm to the support portion; wherein the contact is formed by stamping a sheet of metal, the arms originally extend from the inner edges of the corresponding support portions toward the opposite support portion and then bend in an arc 90 degrees, forming the arc portions.

2. The contact as claimed in claim 1, wherein a length of the support section is much greater than a width of the support sections so that the support sections are relatively readily deflected.

3. The contact as claimed in claim 1, wherein a retention portion is formed on the base portion for retaining the contact in the channel.

4. The contact as claimed in claim 3, wherein the retention portion comprises a barb formed on each of two opposite side edges of the base portion.

5. The contact as claimed in claim 1, wherein the soldering portion forms a platform adapted for carrying a mass of soldering material.

6. A contact assembly comprising:

a contact and a pin;

said contact being formed by stamping a sheet of metal and including:

a base portion with retention means thereon for retaining the contact in a housing of a connector;

a soldering portion located below said base portion for soldering to a printed circuit board;

a pair of support portions upwardly extending from an upper portion of the base portion with a gap therebetween, both of said pair of support portions essentially extending in a plane; and a pair of arms extending from top portions of inner edges of the corresponding support portions, respectively, in a parallel direction which is perpendicular to said plane; wherein each of said arms defines an arc portion around a joint portion between said each of the arms and the corresponding support portion, and each of said support portions defines a recess to have a width thereabouts being smaller than that of other portions of said support portions so as to have the arc portion of the arm at least partially located in the recess of the corresponding support portion; wherein said pin is sandwiched between said pair of arms.

7. The assembly as claimed in claim 6, said pin is moved along said parallel direction from said arc portions toward distal ends of the arms.

* * * * *